US009812758B2

(12) United States Patent
Burrell et al.

(10) Patent No.: US 9,812,758 B2
(45) Date of Patent: Nov. 7, 2017

(54) ANTENNA FLOOR TILE FOR A RAISED FLOOR SYSTEM

(71) Applicant: TESSCO Communications Incorporated, Hunt Valley, MD (US)

(72) Inventors: Dennis Burrell, Austin, TX (US); Christopher Jufer, San Antonio, TX (US); Timothy Ortel, Timonium, MD (US); Brian Vogel, Holland, MI (US)

(73) Assignee: TESSCO COMMUNICATIONS INCORPORATED, Hunt Valley, MD (US)

( * ) Notice: Subject to any disclaimer, the term of this patent is extended or adjusted under 35 U.S.C. 154(b) by 109 days.

(21) Appl. No.: 14/881,238

(22) Filed: Oct. 13, 2015

(65) Prior Publication Data

US 2016/0118707 A1 Apr. 28, 2016

Related U.S. Application Data

(60) Provisional application No. 62/068,261, filed on Oct. 24, 2014.

(51) Int. Cl.

| | |
|---|---|
| ***H01Q 1/44*** | (2006.01) |
| ***H01Q 1/40*** | (2006.01) |
| ***H01Q 1/00*** | (2006.01) |
| ***E04F 15/024*** | (2006.01) |
| *E04F 15/02* | (2006.01) |

(52) U.S. Cl.

CPC ..... *H01Q 1/007* (2013.01); *E04F 15/02429* (2013.01); *H01Q 1/40* (2013.01); *H01Q 1/44* (2013.01); *E04F 2015/02105* (2013.01)

(58) Field of Classification Search

CPC H01Q 1/007; H01Q 1/12; H01Q 1/40; H01Q 1/44; H01Q 1/2291

See application file for complete search history.

(56) References Cited

U.S. PATENT DOCUMENTS

| | | | | |
|---|---|---|---|---|
| 6,563,465 | B2 * | 5/2003 | Frecska | E04B 9/04 343/700 MS |
| 6,715,246 | B1 * | 4/2004 | Frecska | E04B 9/045 181/150 |
| 6,825,813 | B2 * | 11/2004 | Pecora, Jr. | H01Q 9/16 343/719 |
| 7,770,345 | B2 * | 8/2010 | McConnell | E04F 15/02429 52/126.6 |
| 9,105,972 | B2 * | 8/2015 | Webb | H01Q 1/007 |
| 2011/0011013 | A1 * | 1/2011 | Kanazawa | E04F 15/225 52/167.9 |

FOREIGN PATENT DOCUMENTS

| | | | | |
|---|---|---|---|---|
| EP | 0719980 | A1 * | 7/1996 | E04F 11/166 |

* cited by examiner

*Primary Examiner* — Tho G Phan
*Assistant Examiner* — Patrick Holecek
(74) *Attorney, Agent, or Firm* — Shlesinger, Arkwright & Garvey LLP

(57) ABSTRACT

An antenna floor tile for a raised floor system comprises a frame; an insert supported by the frame, the insert including a top surface; a recess disposed below the top surface; an antenna attached to the insert within the recess; and a protective layer disposed over the antenna.

14 Claims, 4 Drawing Sheets

ANTENNA FLOOR TILE FOR A RAISED FLOOR SYSTEM

RELATED APPLICATION

This is a nonprovisional application of Ser. No. 62/068,261, filed Oct. 24, 2014, the priority benefit of which is hereby claimed and whose disclosure is hereby incorporated by reference.

FIELD OF THE INVENTION

The present invention is generally directed to floor tiles for a raised floor system and in particular to floor tiles incorporating RF antennas for providing Wi-Fi or cellular wireless coverage to users inside a building.

SUMMARY OF THE INVENTION

The present invention provides an antenna floor tile for a raised floor system comprising a frame; an insert supported by the frame, the insert including a top surface; a recess disposed below the top surface; an antenna attached to the insert within the recess; and a protective layer disposed over the antenna.

DETAILED DESCRIPTION OF THE INVENTION

Figure 1:
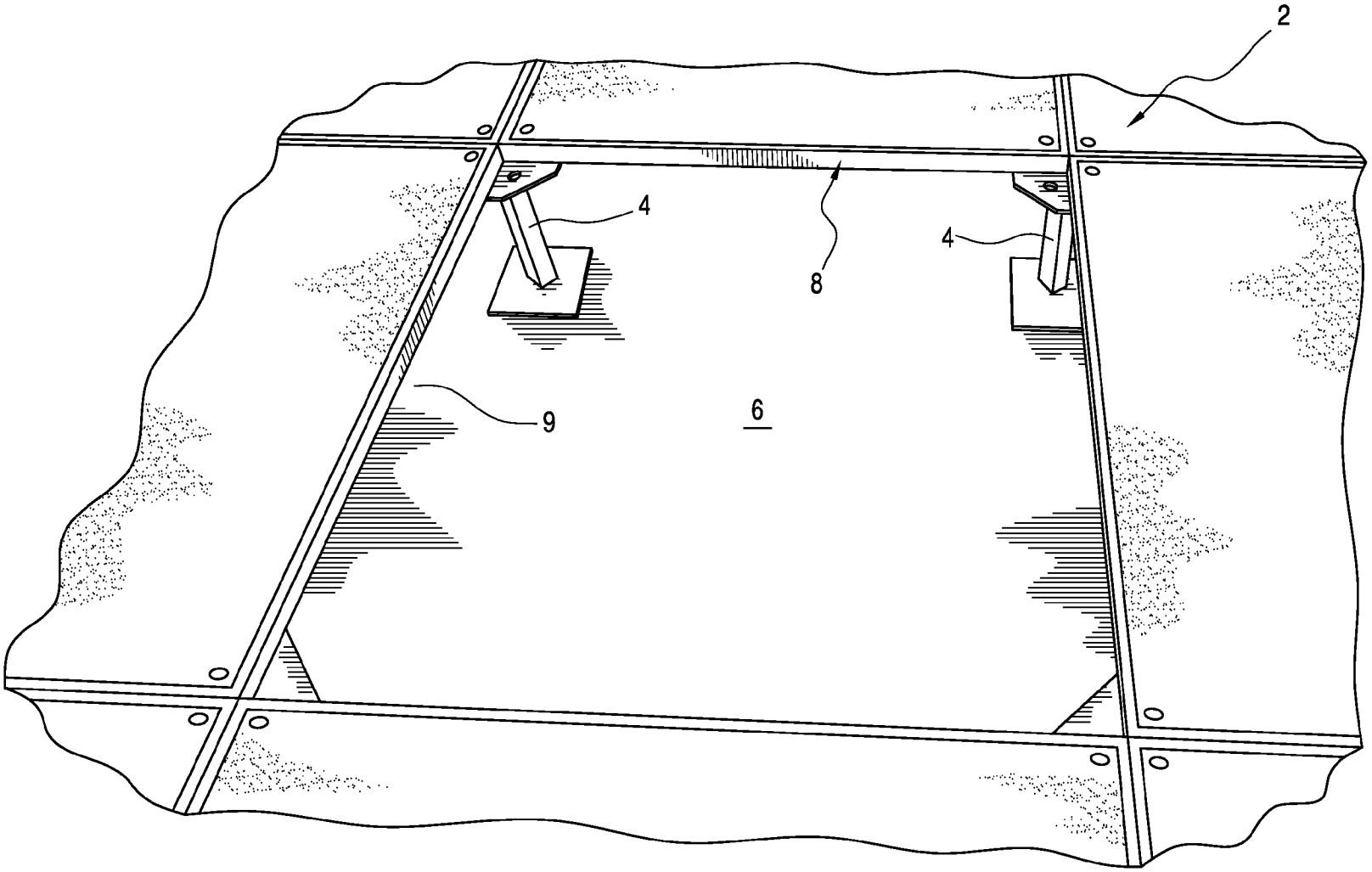
FIG. 1 is a perspective view of a raised floor system with one tile removed.

A conventional raised floor system 2 is shown in FIG. 1. A plurality of pedestals 4 supported on a subfloor 6 of a building are arranged to support a plurality of floor tiles 8. A floor tile 8 is typically 24"×24"×1.25".

The raised floor system 2 provides space 9 below the floor tiles 8 for routing power and communication cables, pipes, HVAC, and other amenities to various points on the floor. The floor tiles 8 are easily removable individually by lifting to gain access to the space 9 below.

Figure 2:
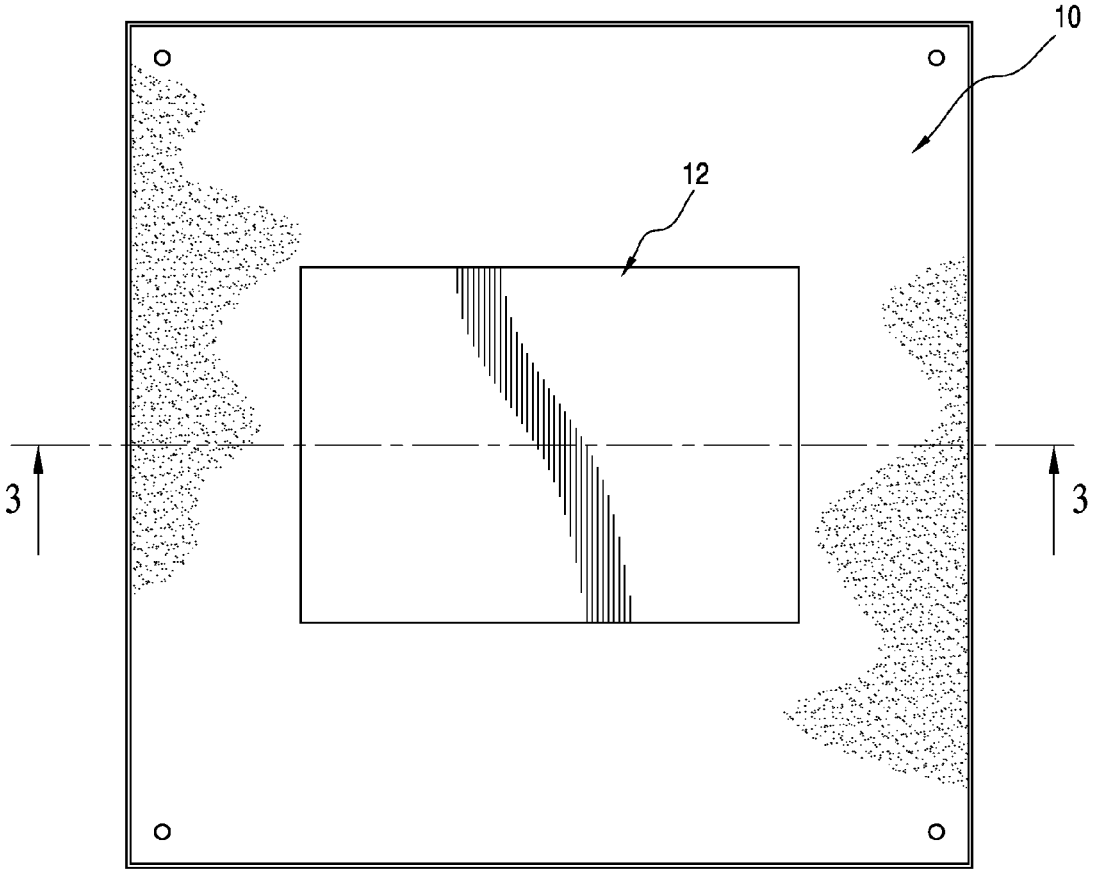
FIG. 2 is a top view of an antenna floor tile made in accordance with the present invention.
Figure 3:
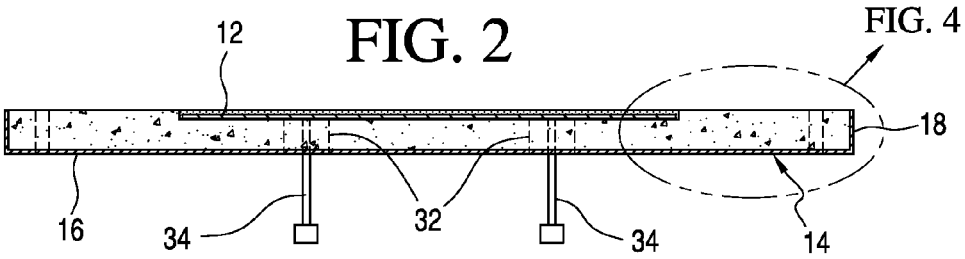
FIG. 3 is a cross-sectional view taken along line 3-3 of FIG. 2.
Figure 4:
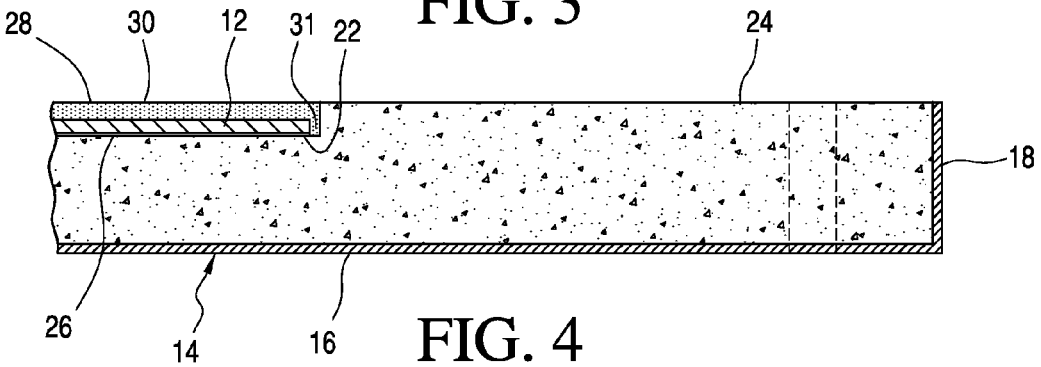
FIG. 4 is an enlarged view of a section taken from FIG. 3.

Referring to FIGS. 2, 3 and 4, the raised floor system 2 includes an antenna floor tile 10 made in accordance with the present invention. The antenna floor tile 10 is a standard floor tile 8, modified as will be described below, to receive a standard RF antenna 12, preferably low profile and substantially flat or planar. The antenna floor tile 10 advantageously fits into the raised floor tile system 2.

The antenna 12 is typically used for Wi-Fi (wireless local area network technology based on the IEEE 802.11 standards) or cellular systems to provide wireless coverage for users of the systems within the building. An example of the antenna 12 has an overall rectangular shape, measuring about 13.8"×6.3"×1.2", a dual band 2.4/5 GHz antenna, Model No. M6030030O32402A, available from TESSCO Communications Incorporated, Hunt Valley, Md.

Referring to FIGS. 3 and 4, the antenna floor tile 10 includes a metal frame 14 with a base wall 16 and side walls 18 attached to the outside edge of the base wall 16. An insert 20, preferably made of concrete, is supported by the frame 14. The insert 20 may also be made of wood or other suitable materials.

A recess 22 is provided below the top surface 24 of the insert 20. The recess 22 is configured to receive the antenna 12 and preferably centered over the insert 20. The recess may be 0.125-0.25" deep, depending on the thickness or profile of the specific antenna used, and preferably includes a flat or planar bottom surface to dispose the antenna 12 below the top surface 24 of the insert 20.

The antenna 12 is attached to the insert 20 at the bottom of the recess 22, preferably with construction adhesive 26. The construction adhesive 26 advantageously provides a cushion to the antenna 12 and serves to seal the antenna holes 32.

Referring to FIG. 4, a protective layer 28 is disposed over the antenna 12. The protective layer 28 is preferably a two-part epoxy applied to fill in the recess 22 over and around the edges of the antenna 12 and including the gap 31 between the edges of the antenna and the side walls of the recess 22. The protective layer 28 advantageously provides a smooth top surface 30. The protective layer 28 bonds with the antenna 12 and the insert material, such as concrete, providing a durable protective coating, advantageously sealing the antenna 12 from the environment. The top surface 30 of the protective layer 28 is preferably flush with the top surface 24 of the insert 20. The protective layer 28 may also be a sheet of durable plastic, such as Plexiglas.

Holes 32 are provided through the thickness of the insert 20 within the area of the recess 22 to allow the leads 34 of the antenna 12 to extend below the raised floor tile system 2 into the space 9 below. The number of the holes 32 depends on the number of connectors attached to the antenna 12 and the type of wireless radio (access point) used.

Figure 5:
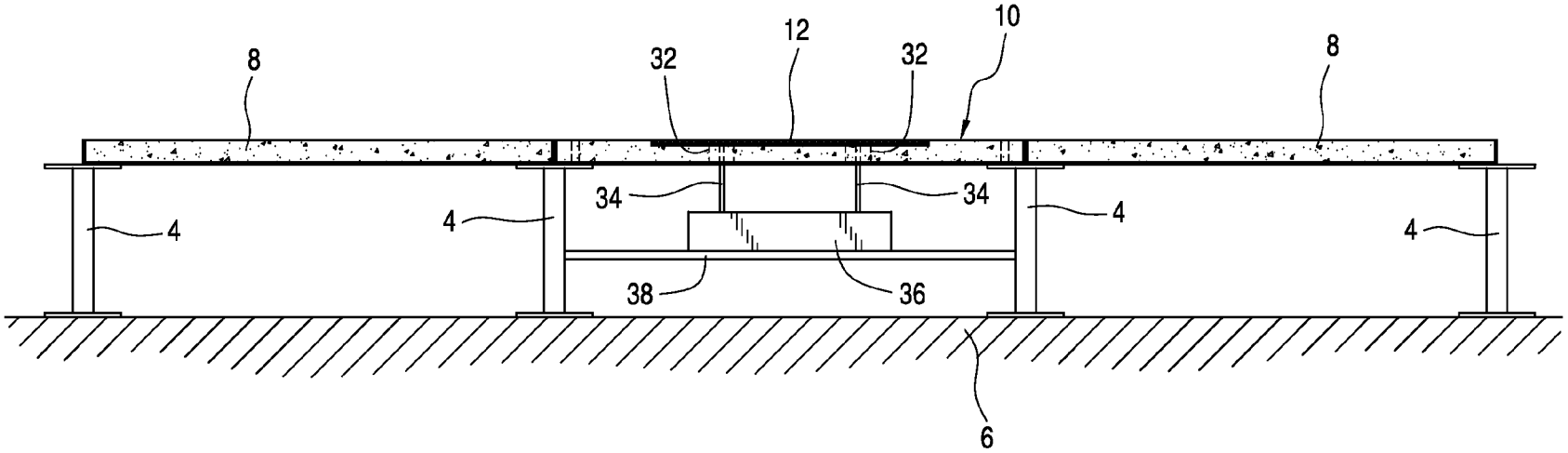
FIG. 5 is a cross-section through the raised floor system of FIG. 1, incorporating the antenna floor tile of FIG. 2.
Figure 6:
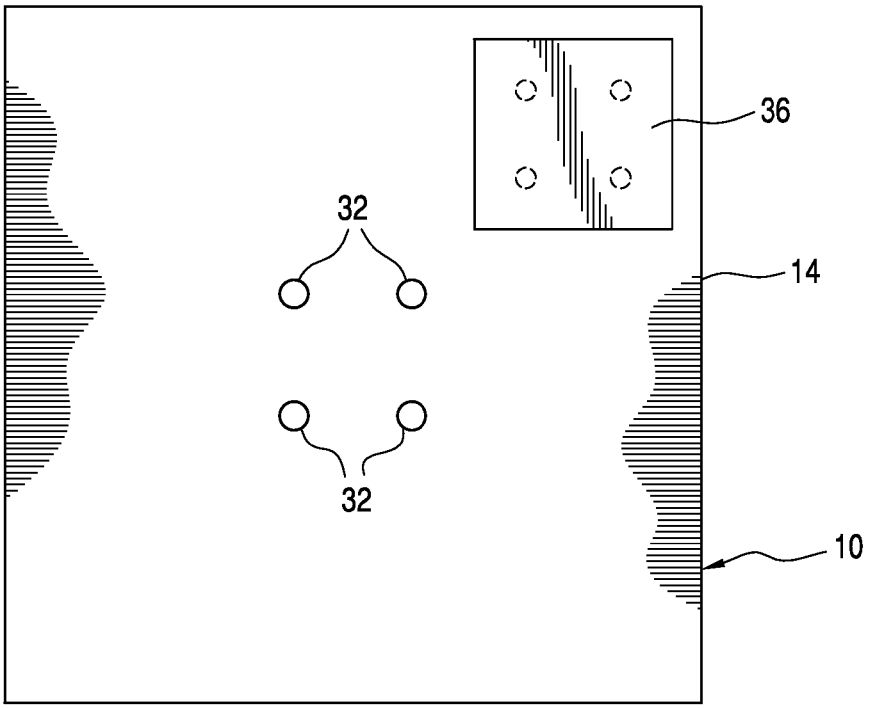
FIG. 6 is an underside view of an antenna floor tile, showing an access point attached to an underside of the tile frame.

Referring to FIG. 5, the antenna leads 34 are connected to an access point (radio) 36 disposed below in the space 9. The access point 36 may be attached to a wire tray 38 or, as shown in FIG. 6, to the underside of the frame 14 with standard screws (not shown).

Figure 7:
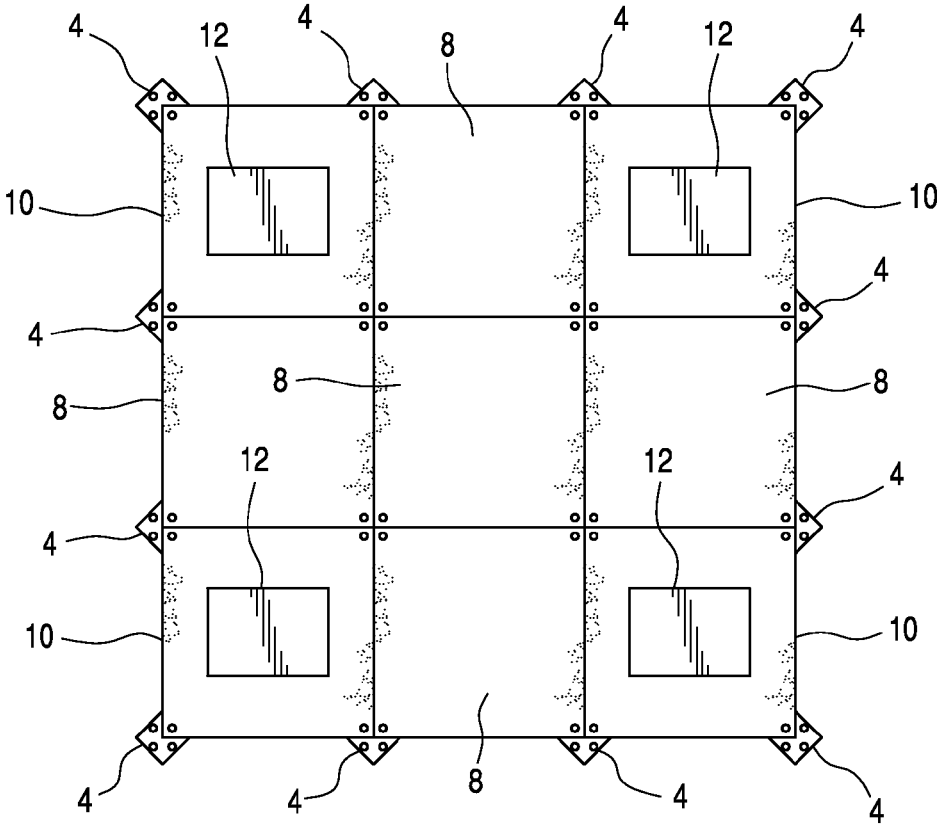
FIG. 7 is a plan view of a raised floor system incorporating a plurality of antenna floor tiles in a pattern.

Referring to Fig. to FIG. 7, a plurality of the antenna floor tiles 10 is shown arranged in a pattern for a specific application. The pattern of the antenna floor tiles 10 will vary based on the building design and layout and the number of users. Each antenna 12 is connected to a separate radio 36. The cluster of antennas 12 is needed because one antenna does not provide full coverage for Wi-Fi or DAS. The number of antennas 12 (which correspond to the number of access points) is determined by performing a site survey. One antenna for one radio will cover a certain area. Therefore, there is a correlation between the antenna floor tiles 10 used and the coverage achieved. Square footage of the building, material of the building and number of users of the Wi-Fi system are factors that play into determining the antenna floor tile layout.

The antenna 12 propagates the RF signal from the antenna to the client (user device) and receives the RF signal from the client device. The antenna 12 connects to the radio 36 that provides the wireless signal via coaxial cables 34. The number of connectors attached to the antenna 12 depends on the type of wireless radio being used. There are typically 3, 4 or 6 cables.

The antennas 12 can be designed for different communication systems, such as Wi-Fi and DAS (Distributed Antenna System) for LTE Cellular systems for indoors to operate with all of the carriers (AT&T, Verizon, Sprint, T-Mobile, international carriers, etc.).

Once the entire standard raised floor system 2 is installed and the building is constructed and based on RF testing, existing standard floor tiles 8 are replaced with the antenna floor tiles 10 to provide RF coverage as needed. The radios 36 are located under the antenna floor tile 10 supported by metal cage trays and power is run to the radio under the flooring. If the building space is rearranged at any time, the antenna floor tiles 10, along with the respective radios 36 can be repositioned to provide the proper RF coverage. With the raised floor system, all of the cables that are typically placed overhead are now routed advantageously beneath the floor. Advantageously, ladders will not be used to maintain the antennas 12 and the access points 36.

The antenna floor tile 10 may be future-proofed by using antenna designs for radios that have not been released yet but still work for existing products. An example is 802.11ac wave 2 technology, which will use up to 8 ports. The antenna 12 can be designed to work with this future technology but the current technology will be used. In other words, the antenna 12 will be designed with 8 ports but only 4 to 6 maximum will be used until the new technology requiring 8 leads is available. For a DAS implementation, current technology starts at 698 MHz but the antennas 12 can be designed to operate down to 570 MHz, when the FCC opens up the frequency spectrum down to 570 MHz.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

We claim:

1. An antenna floor tile for a raised floor system, comprising:

a) a floor tile including a frame having a base wall and side walls attached to outer edges of said base wall;

b) an insert supported by said frame, said insert including a top surface, said insert is disposed within said frame;

c) said insert including a recess with an opening into said top surface;

d) an antenna disposed within said recess; and e) a protective layer disposed over said antenna.

2. The antenna floor tile as in claim 1, wherein antenna leads from said antenna extend through the thickness of said insert.

3. The antenna floor tile as in claim 1, and further comprising an adhesive layer disposed between said antenna and said insert.

4. The antenna floor tile as in claim 1, wherein said protective layer includes epoxy.

5. The antenna floor tile as in claim 1, wherein said protective layer is flush with said top surface.

6. The antenna floor tile as in claim 1, wherein said recess is rectangular in top view and centered on said top surface.

7. The antenna floor tile as in claim 2, wherein:

a) said insert includes openings through said recess; and b) said antenna leads extend through said openings.

8. The antenna floor tile as in claim 1, and further comprising a radio attached to an underside of said frame.

9. The antenna floor tile as in claim 1, wherein said protective layer includes a plastic glass.

10. The antenna floor tile as in claim 1, wherein said insert is made of concrete.

11. The antenna floor tile as in claim 1, wherein said antenna is rectangular in overall shape.

12. The antenna floor tile as in claim 1, wherein said antenna is low profile and substantially planar.

13. The antenna floor tile as in claim 1, wherein said antenna is configured for a Wi-Fi or cellular system.

14. The antenna floor tile as in claim 6, wherein said recess includes a flat bottom surface.

* * * * *